US005866524A

United States Patent [19]

Wevers

[11] Patent Number: 5,866,524

[45] Date of Patent: Feb. 2, 1999

[54] FOAMED CLEANING COMPOSITIONS AND METHOD OF TREATING TEXTILE FABRICS

[75] Inventor: Jean Wevers, Heide, Belgium

[73] Assignee: Procter & Gamble Company, Cincinnati, Ohio

[21] Appl. No.: 718,438

[22] PCT Filed: Mar. 10, 1995

[86] PCT No.: PCT/US95/02781

§ 371 Date: Sep. 27, 1996

§ 102(e) Date: Sep. 27, 1996

[87] PCT Pub. No.: WO95/27026

PCT Pub. Date: Oct. 12, 1995

[30] Foreign Application Priority Data

| | | | |
|---|---|---|---|
| Mar. 30, 1994 | [EP] | European Pat. Off. | 94200867 |
| Dec. 4, 1994 | [EP] | European Pat. Off. | 94870189 |

[51] Int. Cl.[6] ..... C11D 10/02; C11D 3/43; C11D 1/22

[52] U.S. Cl. ..... 510/279; 510/280; 510/352; 510/370; 510/426; 510/427

[58] Field of Search ..... 510/406, 424, 510/426, 278, 279, 280, 351, 352, 370, 427

[56] References Cited

U.S. PATENT DOCUMENTS

| | | | |
|---|---|---|---|
| 3,796,599 | 3/1974 | McLaughlin . | |
| 4,026,825 | 5/1977 | Steen et al. | 252/547 |
| 4,118,189 | 10/1978 | Reinwald et al. . | |
| 4,242,377 | 12/1980 | Roberts et al. . | |
| 4,252,656 | 2/1981 | Liebowitz | 252/8.8 |
| 4,295,845 | 10/1981 | Sepulveda et al. | 8/139.1 |
| 4,363,756 | 12/1982 | Sepulveda et al. | 252/550 |
| 4,457,857 | 7/1984 | Sepulveda et al. | 252/174.21 |
| 4,499,620 | 2/1985 | Minagawa . | |
| 4,563,186 | 1/1986 | Flynn et al. | 8/137 |
| 4,636,328 | 1/1987 | Flynn et al. | 252/90 |
| 4,652,389 | 3/1987 | Moll | 252/90 |
| 4,720,351 | 1/1988 | Flynn et al. | 252/90 |
| 4,780,100 | 10/1988 | Moll | 8/137 |
| 4,963,158 | 10/1990 | Beaujean et al. | 8/137 |
| 5,332,528 | 7/1994 | Pan et al. | 252/548 |
| 5,635,469 | 6/1997 | Fowler et al. | 510/406 |

*Primary Examiner*—Paul Lieberman
*Assistant Examiner*—Nicholas Ogden
*Attorney, Agent, or Firm*—Kim W. Zerby; Brian M. Bolam; Richard S. Echler, Sr.

[57] ABSTRACT

The invention relates to a foam composition for cleaning textiles comprising detergent active components, including a surfactant system. The surfactant system consists of anionic surfactant and, optionally, nonionic surfactant, at a level of at least 18% by weight. Preferably both anionic and nonionic surfactants are present in the surfactant system of the foam. The invention also relates to a method of cleaning textiles using foamed compositions, and also to a packaged product for delivering the foamed compositions.

35 Claims, No Drawings

FOAMED CLEANING COMPOSITIONS AND METHOD OF TREATING TEXTILE FABRICS

The process of cleaning and conditioning textile fabrics has been carried out by various means for many centuries. Recently many improvements and refinements have been made to give more efficient processes for cleaning and conditioning textile fabrics. Modern-day processes basically involve a system to deliver active cleaning or conditioning materials to the fibre surface.

Many processes achieve this goal by immersing the textile fabrics in a solution, usually an aqueous solution of active materials. The solution soaks the fabrics thereby delivering the active materials to the fibre surface. Suitable solutions, or washing liquors, are often prepared by dissolving granular detergent products in water, or alternatively by dissolving liquid detergent in water.

Washing machines in common use in Western Europe provide a dispensing drawer which is specifically intended to mix detergent active products, either granular or liquid, with water. The mixture or solution is then delivered into a drum which contains the washing load (i.e. the textile fabrics). This method of delivery has been still further improved by the use of dispensing devices which can be filled with detergent active products and then loaded directly into the drum with the washing load. When the drum is filled with water, the high local concentrations of active materials gives the so-called "heart-of-the-wash" effect.

Other methods of delivering active materials to the fibre surface are known. For example impregnated sheets may be used to clean or condition fabrics if the impregnating materials include cleaning or conditioning agents.

Another refinement of the cleaning process has been the use of pretreatment on particularly difficult stains. Using this approach a concentrated detergent product is applied directly to the textile fabric in the region of the stain. This delivers a high concentration of detergent active materials at the fibre surface where it has maximum effect. Most recently the consumer has been encouraged to pretreat local areas of textile fabrics with concentrated liquid detergents, and then to wash the whole of the item in a dilute aqueous solution of the liquid detergent. This offers benefits of delivering a high concentration of the detergent active materials directly to the fibre surface, at least in areas where there are stains, and subsequently cleaning the whole of the fabric by immersing it in a washing solution. However, pretreatment is generally limited to local regions of the textile fabric.

The present invention offers a significant discontinuity in the method of delivering detergent active materials at the fibre surface. Furthermore, the present invention offers a means of delivering high concentrations of detergent active materials to all parts of the textile fabric, and not simply to local areas of the fabric, as in the case of pretreatment. This, in turn, leads to a highly efficient process of cleaning and conditioning textile fabrics resulting in a reduced requirement for detergent active ingredients giving lower costs, lower energy requirements and environmental benefits.

U.S. Pat. No. 4,118,189, issued on Oct. 3rd 1978, describes a method of washing textiles with a foamed detergent solution. The aqueous solution contains from 10 to 50 grams per liter of cleaning composition (from about 1% to about 5% by weight of "active" cleaning components in aqueous solution). The foam is formed by providing a source of compressed air which is blown into the aqueous solution, the foam is then contacted with the textiles. After collapse of the foam it is recycled by further applications of compressed air at least five times.

U.S. Pat. No. 4,499,620, issued on Feb. 19th 1985, describes a foam washing method. The foam is formed by blowing a gas through a "concentrated" aqueous solution of a detergent. Typical concentrations of aqueous solution as defined in this patent are from 0.3 to 1% by weight.

U.S. Pat. No. 3,796,599, issued on Mar. 12th 1974, describes a method for treating clothes in a clothes dryer with a foam. Anionic surfactants such as sulphonates are described as useful foaming agents. The highest concentration of anionic surfactant disclosed is 13% by weight (in Example XIII—weight percentage being calculated on the basis of all components excluding the propellant).

U.S. Pat. No. 4,242,377, issued on Dec. 30th 1980, describes foaming compositions which are used for fabric conditioning and which are suitably dispensed from aerosol containers.

The conditioning step is generally intended to be carried out on fabrics that have already been cleaned. Anionic surfactants are disclosed which may act as conditioning agents and/or as foaming agents. Example 6 describes a foaming composition comprising 17.8% sodium soap (by weight, excluding propellant).

U.S. Pat. No. 4,252,656, issued on Feb. 24th, 1981, describes compositions similar to '377 patent. The surfactant level (anionic+nonionic+soap) is preferably from 0.5% to 10% by weight of the composition.

None of the prior art documents suggests a concentrated detergent foam in which anionic and/or nonionic surfactants may be incorporated in order to achieve efficient cleaning of fabrics.

The present invention aims to provide a foamed detergent composition for effectively cleaning textiles. A method of cleaning textiles is also provided for delivering detergent active materials on to the textile fabrics in the form of a high active foam. The foam comprises at least 18% by weight of anionic and/or nonionic surfactant and has a very high volume for a given weight of detergent active material due to the large amount of gas which is trapped within it. For the same reason the foam also has a very high surface area for a given weight of detergent active material which enables the surfaces of the textile fabric to be covered by the foam thereby delivering a concentrated detergent material uniformly over the fabric and directly to the fabric surface.

SUMMARY OF THE INVENTION

The invention relates to a foam composition for cleaning textiles comprising detergent active components, including a surfactant system. The surfactant system consists of anionic surfactant and, optionally, nonionic surfactant, at a level of at least 18% by weight of the foam composition. Preferably both anionic and nonionic surfactants are present in the surfactant system of the foam.

Most useful foams have a density of less than 100 grams per liter, preferably less than 50 grams per liter.

Preferred surfactants for use in the foam compositions are alkyl sulphate, alkyl ether sulphate, or mixtures thereof, at a level of at least 18% by weight of the composition.

Surfactants may advantageously be present at levels of at least 25%, preferably at least 50% by weight. Where nonionic surfactants are used they may advantageously be present at levels of at least 20%, preferably at least 25% by weight.

It is also preferred that the foam composition comprises less that 50%, preferably less that 30%, more preferably less than 10% by weight of water.

Another aspect of the invention is a method of cleaning textiles by foam having a composition as described above.

The foam is distributed over the textiles and preferably the ratio of water present to dry fabric is less than 1:1, preferably less than 2:3, and more preferably less than 1:2.

The foam may be distributed over the surface of the textiles manually (i.e. "handwash") or alternatively by mechanical means, any foam or foam residue on the textiles subsequently being substantially removed by application of vacuum, by blowing a gas, or by rinsing. The mechanical means is provided by the rotating action of a washing machine (i.e. "machine wash").

A third aspect of the invention is a packaged product comprising (i) a foaming detergent composition comprising a surfactant system, the surfactant system consisting of anionic surfactant and, optionally, nonionic surfactant;

(ii) a propellant gas; and (iii) an aerosol container, the detergent composition and the propellant gas being packaged in the aerosol container characterised in that the composition comprises at least 18% by weight of the surfactant system.

The packaged product delivers foam compositions as described above.

DETAILED DESCRIPTION OF THE INVENTION

A preferred method of cleaning textile fabrics according to the present invention is by handwashing using a foam comprising detergent active materials. The method comprises the first step of delivering the foam over the whole surface of the textile fabric and, preferably allowing time to soak so that the concentrated detergent may act at the fibre surface. In a subsequent step water may be added to give a more dilute detergent solution in which the washing process may be continued. Optionally the textile fabrics may finally be rinsed in clean water. This aspect of the invention offers particular benefits for delicate textile fabrics such as those made from wool or silk. The foam delivers detergent active materials to the fibre surface without the need for soaking in water.

An alternative method of cleaning textile fabrics according to the present invention is by adding a foam comprising detergent active materials to the textile fabrics in a conventional washing machine. The method comprises the first step of delivering the foam over the whole surface of the textile fabric and, preferably allowing time to soak so that the concentrated detergent may act at the fibre surface. During this step the foam may be effectively distributed over the surface of the textile fabric by agitation, for example by the tumbling action of the machine drum. In a subsequent step water may be added to give a more dilute detergent solution in which the washing process may be continued. The cleaning process is highly efficient due to the mechanical work input of the washing machine effectively and rapidly distributing the foam over the whole surface of the textile fabrics. As a result lower washing temperatures and shorter cycles are possible with corresponding benefits of low energy use.

The present invention is also concerned with a packaged product for delivering a foam comprising detergent active materials to textile fabrics. The means comprises a sealed container having a nozzle which can be activated by the consumer. The container comprises a detergent active material and a compressed propellant gas. When the nozzle is activated the propellant forces the detergent active material out of the sealed container. At the same time the propellant expands to form a myriad of gas bubbles in a foam. Most preferably the packaged product comprises an aerosol container.

Textile fabrics are any materials made from cloth, including garments such as shirts, blouses, socks, skirts, trousers, jackets, underwear etc, and also including tablecloths, towels, curtains etc. The definition of textile fabrics as used herein does not include carpets and similar floor coverings.

Textile fabrics which are to be used in the present invention are commonly made by weaving or knitting. Many different fibres may be used to produce woven, knitted or other types of textile fabric including synthetic fibres (such as polyester, polyamide, etc.) and natural fibres from plants (such as cotton, hemp) and from animals (such as wool, angora, silk). Blends of different fibres are also commonly used.

Foam is a coarse dispersion of gas in a relatively small amount of liquid. The foams of the present invention are a continuous liquid phase comprising a detergent composition, and a dispersed phase comprising a gas. The gas "bubbles" of the dispersed phase can vary in size from 50 micrometers to several millimeters.

In general, the quality of the foam is determined by assessing various foam quality attributes, such as: 1) the appearance of the foam as it is determined by the uniformity of the bubble size distribution, as well as by the actual bubble sizes, wherein small and uniformly sized bubbles are generally preferred; 2) the thickness of the foam as it is determined by the apparent foam viscosity, wherein a greater apparent foam viscosity is generally preferred; 3) the density of the foam which is preferably less than 100 g/l, more preferably less than 50 g/l, even more preferably less than 20 g/l, and most preferably less than 10 g/l; and 4) the drainage of the liquid from the foam upon standing, wherein lack of drainage of the liquid is generally preferred.

The surfactant system of the present invention consists of anionic surfactant and, optionally, nonionic surfactant. The use of other surfactants in addition to anionic and nonionic surfactants is not excluded, however these are not considered as components of the surfactant system as defined herein. Such additional surfactants included cationic, amphoteric and zwitterionic surfactants, which when used, are preferably incorporated at levels of less than 10%, preferably less than 5%, more preferably less than 1% by weight, and most preferably excluded.

Anionic surfactants useful in the present invention include the conventional C11–18 alkyl benzene sulphonates ("LAS") and primary, branched chain and random C10–20 alkyl sulphates ("AS"), the secondary (2,3) alkyl sulphates of the formula $CH_3$ $(CH_2)_x$ $(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilising cation, especially sodium, unsaturated sulphates such as oleyl sulphate, the C10–18 alkyl alkoxy sulphates ("AExS"; especially EO 1–7 ethoxy sulphates), C10–18 alkyl alkoxy carboxylates (especially the EO 1–5 ethoxycarboxylates), the C10–18 glycerol ethers, the C10–18 alkyl polyglycosides and their corresponding sulphated polyglycosides, and C12–18 alpha-sulphonated fatty acid esters. C10–C20 conventional soaps may also be used, preferred are the branched chain C10–C16 soaps. Suitable nonionic surfactants include the C12–18 alkyl ethoxylates ("AE") including the so-called narrow peaked alkyl ethoxylates and C6–C12 alkyl phenol alkoxylates (especially ethoxylates and mixed ethoxy/propoxy), as well as C10–C18 N-alkyl polyhydroxy fatty acid amides such as C12–18 N-methylglucamides (as described in WO9206154). Other sugar-derived surfactants include the N-alkoxy polyhydroxy fatty acid amides, such as C10–C18 N-(3-methoxypropyl) glucamide. Further details of suitable detergent components may be found in standard texts, such as A. Davidsohn and B. M. Mildwidsky, *Synthetic Detergents*, John Wiley & Sons, 6th edition, 1978 which discloses general detergency teachings.

It is important to distinguish between the foam of the present invention and the suds which are commonly encountered in everyday washing process. The foam of the present invention is much more concentrated and comprises less water than conventional suds. Foam comprises less than 90%, preferably less than 75%, more preferably less than 50%, even more preferably less than 30%, and most preferably less than 15% by weight of water. The foam of the present invention comprises at least 18% by weight, preferably at least 25% by weight, and more preferably at least 50% by weight of a surfactant system. Most preferred foams for use as cleaning compositions comprise at least 18% by weight of anionic surfactant.

On the other hand, suds, which are formed in conventional washing process when detergents are diluted prior to washing, are formed from quite dilute solutions typically 100 g of product in 10 liters of water. The result is a wash liquor which comprises about 99% by weight of water. A layer of suds may form on the surface of the wash liquor, the composition of the suds being similar to that of the wash liquor itself. The surfactant content of the suds will normally be much less than 1%, typically less than 0.3%. Consequently the difference between the foam of the present invention and the suds of a conventional washing process will be understood.

It will also be recognised by the man skilled in the art that suds are often considered undesirable in the washing process and antisuds agents are often employed to reduce or control them. In a washing process in which the solution of detergent active agents is the medium of transport of the actives to the fibre surface, the presence of suds can diminish washing performance. This is because the detergent actives which are in the suds are no longer dissolved in the washing liquor itself, and are not therefore efficiently transported to the fibre surface.

In contrast, the foam of the present invention is the essential medium of the washing process. Generally, it is intended that it is the foam itself that delivers the detergent active agents uniformly over the fibres, and not, as in conventional washing processes, an aqueous solution of the actives. However, this does not exclude the step of presoaking the textile fabrics prior to the treatment with the foam from the present invention. It is preferred that no additional water is added to the textile fibres and foam, at least during the step of the method in which the foam is uniformly distributed over the textile fabrics.

Particular embodiments of the method of treating textile fabrics with detergent foam will now be described in more detail.

Handwash

The method of the present invention may be used to wash textile fabrics by hand (referred to herein as "handwash"). The foam is dispensed onto or around the textile fabrics to be washed, and then the foam is thoroughly distributed over the textile fabrics, if necessary, by agitating the textile fabrics and foam by hand. It is believed that the high surface area of the foam enables the active ingredients to be well-distributed over the surface of the textile fabrics. Furthermore it is believed that the intimate proximity of the active, non-diluted foam to the textile fabrics promotes excellent cleaning.

The textile fabrics may be left to soak in the foam for anything up to several days, or even weeks. However it is preferred that the soaking time is between 1 minute and 24 hours, preferably between 5 minutes and 4 hours.

If desired any foam residue may subsequently be removed from the textile fabrics. For example the residue may be rinsed out using clean water or it may be removed from the textile fabrics by applying a vacuum.

The method of the present invention is particularly well-suited to hand washing of delicate textile fabrics. In particular textile fabrics comprising high levels of wool or silk may be advantageously treated in this way. One particular benefit is a marked reduction in local fabric damage which may occur when conventional laundry processes are used. In conventional laundry processes the detergent composition, the soiled textile fabrics and water are all brought together in a suitable container. At the beginning of the process there are very high local concentrations of active ingredients as they begin to dissolve in the water, but before they have been homogeneously distributed in the water. Such high local concentrations in solution, if they happen to be present on or close to the fabric can cause local fabric damage. This is especially true in the case of high local concentrations of bleaching agents and optical brighteners in solution. This type of local fabric damage is avoided according to the method of the present invention. Because all of the active ingredients are uniformly distributed throughout the large volume of the foam there are no local concentrations of active materials which might cause fabric damage.

A typical handwash composition will comprise some or all of the following components: surfactants (anionic, nonionic, cationic, amphoteric, zwitterionic), detergent builders and chelating agents, soil release polymers, optical brightener, dye transfer inhibition polymer, perfume, enzymes, colorants.

Surfactants are preferably present at a level of from 18% to 90% by weight of the composition, preferably 25% to 80% of the composition, more preferably from 30% to 50% by weight of the composition.

Detergent builders such as fatty acids, citric acid, succinic acid, phosphate, zeolite are preferably present at a level of from 10% to 82% by weight of the composition, preferably 10% to 50% of the composition, more preferably from 12% to 20% by weight of the composition. Chelating agent such as phosphonate are preferably present at a level of from 0% to 5%, more preferably from 0.1% to 3% by weight of the composition.

Machine Wash

The method of the present invention may be used to wash textile fabrics in a conventional washing machine (referred to herein as "machine wash"). The foam of the present invention is simply dispensed into the drum of the washing machine either before or after the soiled textile fabrics have been loaded.

Most commercially available washing machines have automatic washing cycles, and many of these cycles start by the addition of water into the machine drum. However, to fall within the scope of the present invention it is necessary for the concentrated foam to be thoroughly dispersed over the textile fabrics without being dissolved in solution. Preferably this is achieved using a washing machine with a washing cycle in which the drum is rotated several times (thereby distributing the foam) before any water is added. However, this does not exclude the step of presoaking the textile fabrics prior to the treatment with the foam from the present invention.

When water is added at a later part of the cycle most of the foam components will be dissolved or dispersed in the water, probably resulting in a layer of suds in the machine. As noted above, these suds which have a high water content and a low surfactant content should not be considered as foam within the meaning of the present invention.

The wash cycle may be completed by any combination of washing, rinsing, conditioning and/or drying steps, during any one of which additional wash or rinse additives may be introduced into the machine drum.

The compositions suitable for machine wash foams are similar to those described above for handwash foams.

Packaged Product

Another aspect of the present invention is a packaged product for delivering a foam suitable for using in the method of the present invention. The packaged product comprises a sealed container, such as an essentially cylindrical bottle, having a dispensing means such as a nozzle. The container contains the detergent composition and a compressed gas and may be made from any material, especially aluminium, tin-plate, plastics including PET, OPP, PE or polyamide and including mixtures, laminates or other combinations of these. Foam is dispensed when the nozzle is activated and the detergent is released together with the gas. The gas acts as a propellant and expands to form many "bubbles" within the detergent composition thereby creating the foam. Preferred gases include fluorocarbons, chlorofluorocarbons, H-chlorofluorocarbons, alkanes such as methane, ethane, propane, butane, pentane as well as nitrogen and nitrous oxides, ammonia and derivatives, air, dimethyl ether and mixtures of these.

Various ways to pressurise the propellant gas are known in the art. For example the gas may be pressurised at the time of packing. The product may be physically separated from a compressed gas by a membrane such as rubber under tension. Alternatively a means for pressurising the gas subsequently by mechanical action may be provided (so-called "pump and spray" systems).

Various apparatus for delivering foams are described in the applicants co-pending application, U.S. Ser. No. 08/075190, filed on 6th Oct. 1993 entitled "Foam Dispensing Nozzles and Dispensers Employing Said Nozzles".

Any nozzle or nozzle/valve assembly which provides a means for releasing the mixture of detergent ingredients from the container and provides a foam is suitable for use in the present invention. The Precision Valve Company (Valve Precision in France) supplies a range of nozzle assemblies for various applications including shaving foams, beauty care applications and carpet cleaners under various trade names including City®, Montego®, Power Jet®, Vulcan® and Visco®. Nozzles which disperse the foam both horizontally and vertically (when the container is held upright) are available. Metering nozzles which dispense a predetermined amount of foam are also available and useful in the present invention. Metering nozzles are disclosed in WO9108965 (Precision Valve Co) and EP-A 616 953 (3M Co). Particularly preferred is a vertical dispensing nozzle. In order for the apparatus to be effective in the method of the present invention it should deliver the foam at a rate of at least 3 g per second of foam from the sealed container, more preferably at a rate of at least 10 g per second, and most preferably at a rate of at least 20 g per second.

EXAMPLES

Example 1

Handwash Product

| | % by weight | % by weight | % by weight |
|---|---|---|---|
| Alkyl sulphate | 15% | 15% | 12.5% |
| Alkyl ether sulphate | 3% | 3% | 12.5% |
| Nonionic surfactant (C25E7*) | 5% | 5% | 17.8% |
| C12–18 N-methylglucamide | 6.5% | 6.5% | 6.8% |
| Fatty acid | 10% | 10% | 14.8% |
| Citric acid | 2% | 2% | — |
| Phosphonate | 1% | 1% | 1.5% |
| Propane Diol | 15% | 15% | 13.1% |
| Ethanol | 1.5% | 1.5% | 1.3% |
| Perfume | 0.5% | 0.5% | 1.2% |
| Soil release polymer | 0.5% | 0.5% | 0.35% |
| Optical Brightener | 0.15% | 0.15% | — |
| Dye transfer inhibitor | 0.02% | 0.02% | — |
| Boric acid | 3% | 3% | — |
| MEA borate | — | — | 4.5% |
| Enzymes | — | 0.76% | 0.76% |
| Opacifier | — | — | 0.68% |
| FOB Base | — | — | 0.24% |
| EXB Base | — | — | 0.03% |
| Monoethanolamine | 9.5% (trim to pH 8.5) | 9.5% (trim to pH 8.5) | — |
| NaOH | — | — | 2.5% (trim to pH 7.8) |
| Water | to balance (~27.3%) | to balance (~26.5%) | to balance (~9.5%) |
| Viscosity = | 250 mPas | 250 mPas | 775 mPas |
| Density = | 1.04 g/l | 1.04 g/l | |

*C25E7 is C12–C15 alkyl ethoxylate having an average of 7 ethoxy groupos per mole.

A liquid handwash product was prepared according to Example 1. 510 grams of the product was packed into metal containers, each container having a nominal capacity of 600 cubic centimeters. 90 grams of gas was then added, and each container was sealed resulting in an internal pressure of about 2.2 bar. The gas used was a mixture of propane and butane (in equal parts). When 40 grams of the product was released by activating a nozzle at the end of the container, a foam was formed having a volume of about 4 liters.

800 grams of laundry consisting of mixed textile fabrics (a typical domestic washing load) was added on top of the foam and agitated by hand until the foam was well dispersed over all of the laundry. The laundry and foam were then left for one hour. Subsequently the laundry was rinsed clean of the residue of the foam using ordinary city water at a temperature of 20° C. The laundry was then dried. Excellent cleaning results were obtained.

Example 2

The method of cleaning described in example 1 was repeated with 0.76% of enzymes added to the composition. The enzymes were a mixed "cocktail" of protease (0.22%), alcalase (0.22%), lipase (0.22%) and cellulase (0.1%).

Example 3

Hand Wash or Machine Wash Product

The product of Example 3 was packed into metal containers with a propellant. In this Example the propellant was a fluorocarbon (134a) in the ratio of 9 parts product to 1 part propellant. The method of cleaning described in Examples 1 and 2 was repeated using the composition of Example 3 delivered from the package as a foam.

Example 4

Machine Wash Product

A typical domestic laundry load was washed in a MIELE® washing machine using a commercially available detergent composition. The composition used was ARIEL® liquid detergent manufactured by Procter and Gamble. 510 grams of the composition was packed into metal containers, each container having a nominal capacity of 600 cubic centimeters. 90 grams of gas was then added, and each container was sealed resulting in an internal pressure of about 2.2 bar. The gas used was a mixture of propane and butane (in equal parts). 40 grams of the product was released from the container in the form of a foam directly into the machine drum containing the laundry load. A prewash cycle without additional water was run to distribute the foam over the fabrics of the laundry load. Water was then added in the main wash cycle, and the foam was dissolved. At the end of the main wash, rinse and drying cycles, excellent cleaning results were obtained.

I claim:

1. A foam composition for cleaning textiles comprising a dispersed gas phase and a continuous liquid phase, the continuous liquid phase comprising a surfactant system consisting of anionic surfactant and optionally, nonionic surfactant, wherein the composition comprises at least 50% by weight of the surfactant system and of the foamed composition of less than 100 grams per liter.

2. A foam composition according to claim 1 wherein the anionic surfactant is selected from the group consisting of alkyl sulfates, alkyl ether sulfates and mixtures thereof, and further wherein the composition comprises at least 18% by weight of the anionic surfactant.

3. A foam composition according to claim 1 comprising at least 25% by weight of the surfactant system and less than 30%, by weight, water, and having a density of the foamed composition of less than 10 grams per liter.

4. A foam composition according to claim 2 comprising at least 20% by weight of nonionic surfactant.

5. A foam composition according to claim 1 claims comprising less that 50%, by weight of water.

6. A method of cleaning textiles using the foam of claim 5 whereby the foam is distributed over the textiles without the foam being dissolved in solution.

7. A method of cleaning textiles using the foam of claim 6 wherein the ratio of water to dry fabric is less then 1:1.

8. A method of cleaning textiles according to claim 7 whereby the foam is distributed over the surface of the textiles by mechanical means, any foam or foam residue on the textiles subsequently being substantially removed by application of vacuum, by blowing a gas, or by rinsing.

9. A method of cleaning textiles using the foam of claim 6 wherein the mechanical means is provided by the rotating action of a washing machine.

10. A packaged product comprising:

(i) a foaming detergent composition comprising a surfactant system, the surfactant system consisting of anionic surfactant and, optionally, nonionic surfactant;

(ii) a propellant gas; and (iii) an aerosol container, the detergent composition and the propellant gas being packaged in the aerosol container, wherein the composition comprises at least 50% of the surfactant system and has a density of the foamed composition of less than 100 grams per liter.

11. A packaged product according to claim 10 wherein the surfactant system consists of alkyl sulphate, alkyl ether sulphate, or mixtures thereof, at a level of at least 18% by weight of the foaming detergent composition.

12. A packaged product according to claim 11 wherein the foaming detergent composition comprises at least 25%, by weight of the surfactant system.

13. A packaged product according to claim 12 wherein the foaming detergent composition comprises at least 25% by weight of nonionic surfactant.

14. A packaged product according to claim 13 wherein the detergent composition comprises less that 50%, by weight of water.

15. A foam composition according to claim 4 wherein the foamed composition has a density of less than 50 grams per liter.

16. A foam composition according to claim 3 comprising at least 50% by weight of the surfactant system.

17. A foam composition according to claim 5 comprising less than 30% by weight of water.

18. A foam composition according to claim 2 comprising less than 10% by weight of water.

19. A packaged product according to claim 12 wherein the foaming detergent composition comprises at least 50% by weight of the surfactant system.

20. A packaged product according to claim 14 wherein the detergent composition comprises less than 30% by weight of water.

21. A packaged product according to claim 20 wherein the detergent composition comprises less than 10% by weight of water.

22. A method of cleaning textiles, comprising the step of distributing over the surface of the textiles a composition comprising propellant and a detergent component which form a foam comprising at least 50%, by weight, of a surfactant selected from the group consisting of alkyl sulfates, alkyl ether sulfates and mixtures thereof and wherein the foamed composition has a density of less than 100 grams per liter.

23. A method according to claim 22, wherein the foam further comprises at least 20%, by weight, nonionic surfactant.

24. A method according to claim 22, wherein the foam is free of cationic, amphoteric and zwitterionic surfactants.

25. A composition for cleaning textiles, comprising propellant and a detergent component which form a foam comprising, by weight, less than 30% water and at least 50% surfactant selected from the group consisting of anionic surfactants and mixtures of anionic and nonionic surfactants, and wherein the foam has a density of the foamed composition of less than 100 grams per liter.

26. A composition according to claim 25, wherein the foam further comprises a C12–C18 N-methylglucamide.

27. A composition according to claim 26, wherein the foam comprises, by weight, at least 18%, of a surfactant selected from the group consisting of alkyl sulfates, alkyl ether sulfates and mixtures thereof.

28. A composition according to claim 25, wherein the foam further comprises from 0.1% to 3%, by weight, chelating agent.

29. A composition according to claim 28, wherein the chelating agent comprises phosphonate.

30. A composition according to claim 25, having a viscosity of from 250 mPas to 775 mPas.

31. A composition in the form of a foam comprising a continuous liquid phase and a dispersed gas phase, wherein the foam has a density of less than 10 grams per liter and comprises, by weight, 50% to 90% surfactant, 10% to 82% builder, 0.1% to 3% phosphonate and less than 30% water, and wherein the surfactant comprises an anionic surfactant.

32. A composition according to claim 31, wherein the surfactant comprises C12–C18 N-methylglucamide.

33. A composition according to claim 31, having a viscosity of from 250 mPas to 775 mPas.

34. A packaged product according to claim 10, wherein the detergent composition comprises, by weight, at least 20% nonionic surfactant, and at least 18% of a surfactant selected from the group consisting of alkyl sulfates, alkyl ether sulfates and mixtures thereof.

35. A method according to claim 22, wherein the propellant is selected from the group consisting of fluorocarbons, chlorofluorocarbons, alkanes, nitrogen, nitrous oxides, ammonia, air, dimethyl ether and mixtures thereof.

* * * * *